United States Patent [19]

Luzzatto

[11] Patent Number: 4,974,483

[45] Date of Patent: Dec. 4, 1990

[54] METRONOME DEVICE

[75] Inventor: Marco Luzzatto, Beer-Sheva, Israel

[73] Assignee: Enterprises 33 Limited, Beer-Sheva, Israel

[21] Appl. No.: 263,428

[22] Filed: Oct. 27, 1988

[30] Foreign Application Priority Data

Nov. 4, 1987 [IL] Israel ..... 84374
Feb. 5, 1988 [IL] Israel ..... 85331

[51] Int. Cl.[5] ..... G04F 5/02

[52] U.S. Cl. ..... 84/484; 84/636; 84/652; 84/668; 84/DIG. 12

[58] Field of Search ..... 84/470 R, 484, DIG. 12, 84/600, 601, 602, 634, 635, 636, 650, 651, 652, 666, 667, 668

[56] References Cited

U.S. PATENT DOCUMENTS 4,583,443 4/1986 Senghass et al. ..... 84/484

*Primary Examiner*—Steven L. Stephan
*Assistant Examiner*—Emanuel Todd Voeltz
*Attorney, Agent, or Firm*—Palmatier & Sjoquist

[57] ABSTRACT

The invention relates to a programmable electronic metronome, capable of registering all meter and speed characteristics of any musical work and of producing, when the musical work is to be performed, substantially sharp, perceivable, e.g. acoustic, signals representing said characteristics in the appropriate succession. The metronome comprises a keyboard for producing signals associated with at least three variables, which are bar number, speed and meter, and defining digital values for said variables, which values are stored in at least one volatile electronic memory, comprising segments severally correlated to each of said variables, to define digital data sequences. The metronome further comprises a reader for the data sequences, whereby to associate to each bar number digital values of speed and meter, and a transducer for transforming said values into electric impulses, which produce a corresponding succession of perceivable signals. Preferably a further transducer, having an inlet/outlet, is provided for transforming said data sequences into recording signals, which may be recorded onto and retrieved from a hard memory.

20 Claims, 7 Drawing Sheets

METRONOME DEVICE

The present invention relates to metronome devices, in particular electronic devices.

Metronomes are essential tools in the practicing of music and of related arts, such as ballet, and are extensively used by performers, conductors, music teachers and pupils, etc. Mechanical and electronic metronomes are known and used, more or less satisfactorily when rythmically simple musical works are to be studied or performed. Modern music, however, in particular 20th century and contemporary music, is often characterized by variations of meter and speed in a given piece, which render the use of the known metronomes difficult and ineffective. Such metronomes are designed to operate at constant frequencies, and when changes of meter and/or speed occur, the metronome has to be stopped and reset, which makes practising or performing awkward and tiresome. In some musical works such changes are so frequent, occurring even almost at every bar, as to render the use of a conventional metronome almost impossible. Further, conventional metronomes do not comprise any means for substituting a non-acoustic signal for the normal audible beat, and therefore are awkward to use when recording.

It is an object of this invention to provide a metronome device which eliminates all the aforesaid drawbacks and overcomes all the aforesaid difficulties. More specifically, it is an object of this invention to provide a metronome device that is programmable, in the sense that the operator may store or register therein all meter and speed characterisrics of every part of any given musical work, no matter how often or drastically they may change, and so practice or perform the entire work without having to stop the metronome to reset it. This results in an unprecedented ease and continuity if practicing and avoids mistakes and negative habits, that are unavoidably caused by the use of the conventional devices.

It is a further object of this invention to provide a metronome device, the operation of which is extremely flexible and which permits to change, according to the preferences of the operator, the number of audible beats and/or their intensity.

It is still another object of invention to provide a metronome device, which is capable of storing all rythmical information relative to one or more musical pieces, for use at any later time.

It is still another object of the invention to provide a metronome device, which can output beat signals that are not acoustic.

It is still another object of the invention to achieve all the aforementioned purposes in a structurally simple and inexpensive manner.

Further objects of the invention will become apparent as the description proceeds.

The metronome device according to the invention is characterized in that it comprises:

means for connecting the device to a source of electric power to energize the several components thereof;

manually controlled means, preferably keyboard controlled means, comprising manually controlled means for producing, when energized, signals associated with at least three variables, which are bar number, speed and meter and defining digital values for said variables;

at least one volatile electronic memory, comprising a plurality of memory segments, for storing said values;

means for correlating at least one of said memory segments to each of said variables and for sequentially conveying each digital variable value to the appropriate segment, to define a digital data sequence;

means for producing substantially sharply defined signals directly perceivable by the human senses;

means for reading the digital data sequences stored in said volatile memory segments, whereby to associate to each bar number or succession of bar numbers digital values of the speed and of the meter;

transducer means for transforming, when activated, said digital values into electric impulses for activating said directly perceivable signal producing means to produce a succession of signals corresponding to the speed and meter values associated with the successive bar numbers; and means for activating said second transducer means.

Preferably the device according to the invention comprises transducer means, provided with an inlet/-outlet, for transforming a digital data sequence stored in the memory segments into a sequence of recording signals suitable for recording onto a hard memory and for transforming said recording signals into a digital data sequence to be stored in said volatile memory segments and means for selectively activating said transducer means to perform either of the aforesaid functions.

Also preferably, said directly perceivable signals comprise pitchless acoustic signals and/or mechanical stimuli and/or optical signals.

More preferably the manually controlled means associated with the speed comprise means for producing a signal representing the frequency of a given submultiple of a bar, and more preferably comprise means for defining the number of fixed, submultiple bar units, having a basic frequency, included in each submultiple.

Still more preferably the means for correlating the volatile memory segments to the variables comprise a CPU and at least one programmable non-volatile memory.

Still more preferably the device comprises means for retrieving the stored digital data sequences and conveying them to transducer means.

Other preferred and optional features of the invention will become apparent as the description proceeds. The invention should however be understood to include and cover all devices comprising equivalents of the components described and claimed, such as as equivalents of memories, CPU, and the like.

The invention will be better understood from a description of two embodiments thereof, with reference to the attached drawings, in which.

Figure 3A:
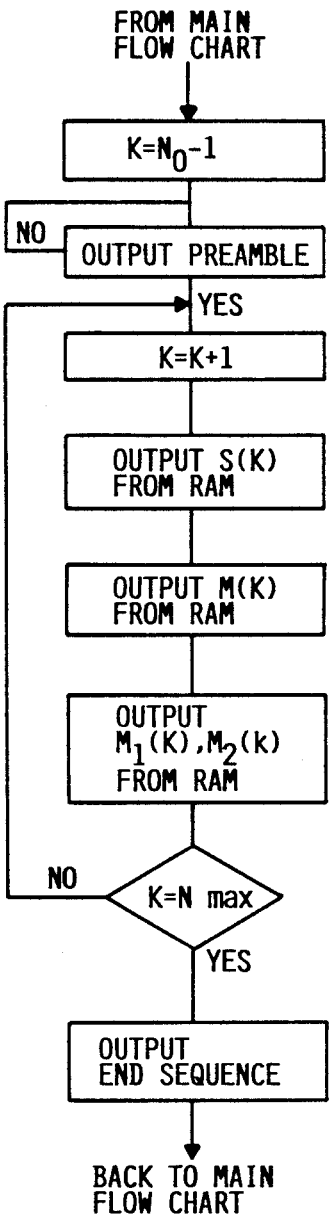
Figure 3B:
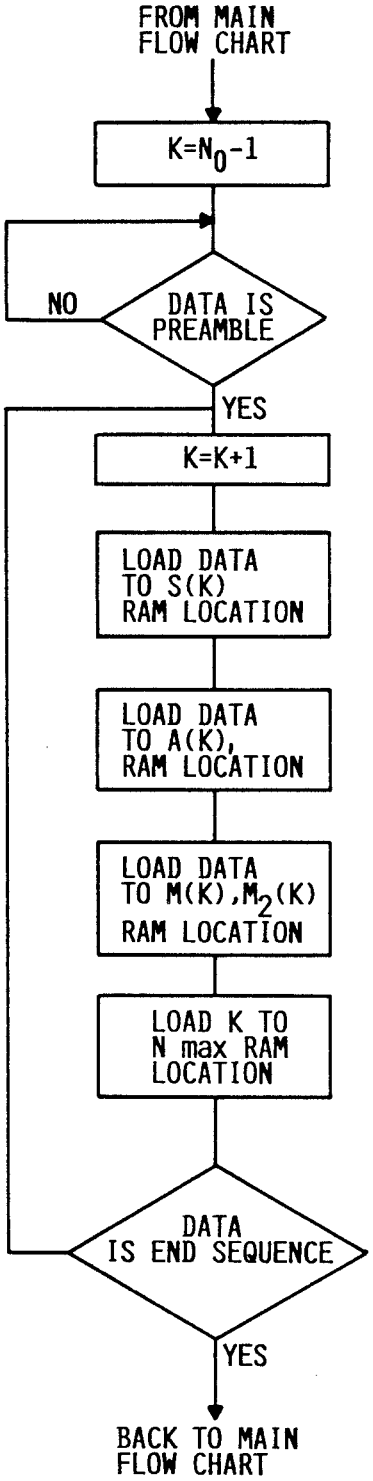
Figure 4:
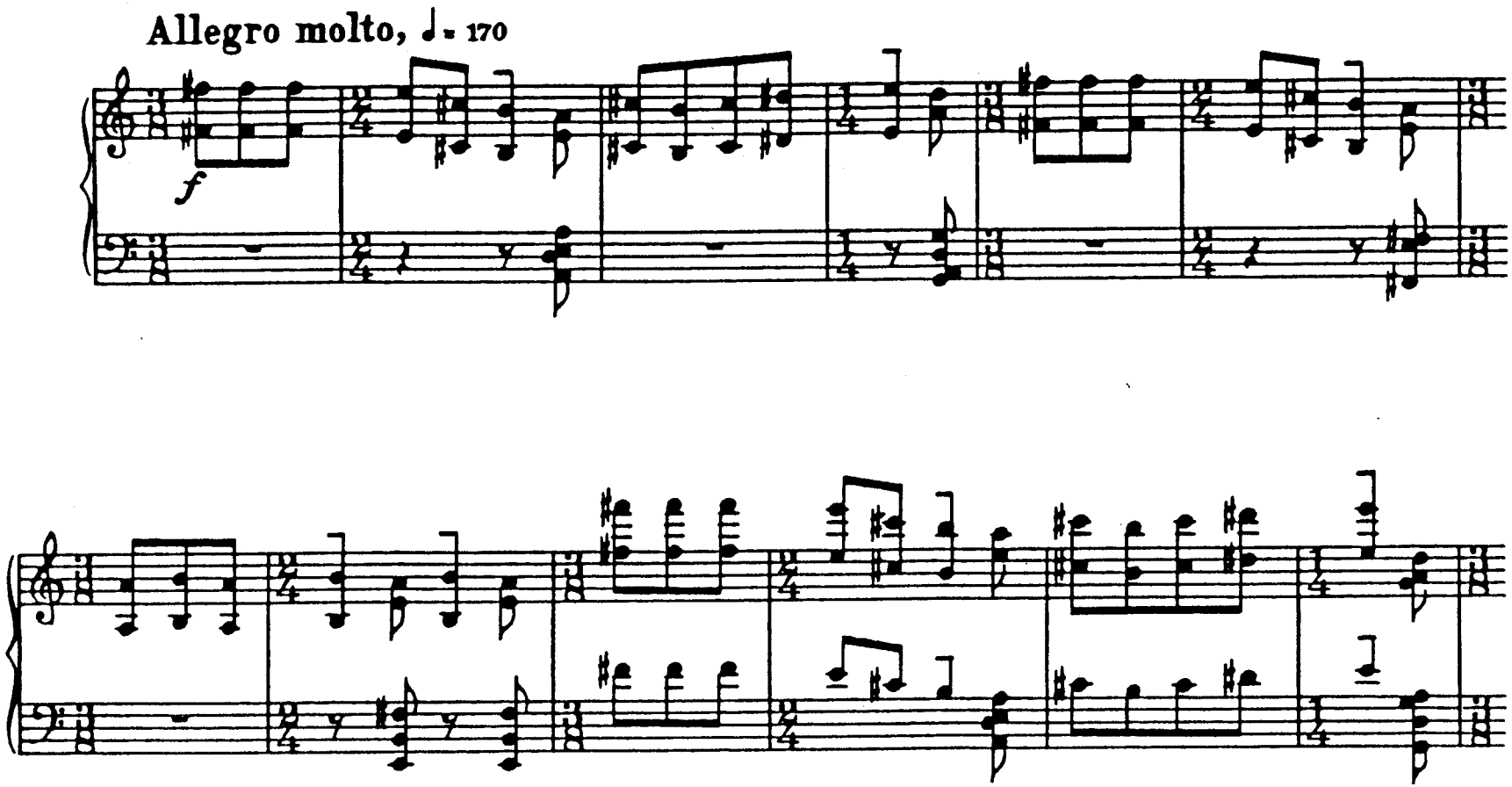
Figure 5:
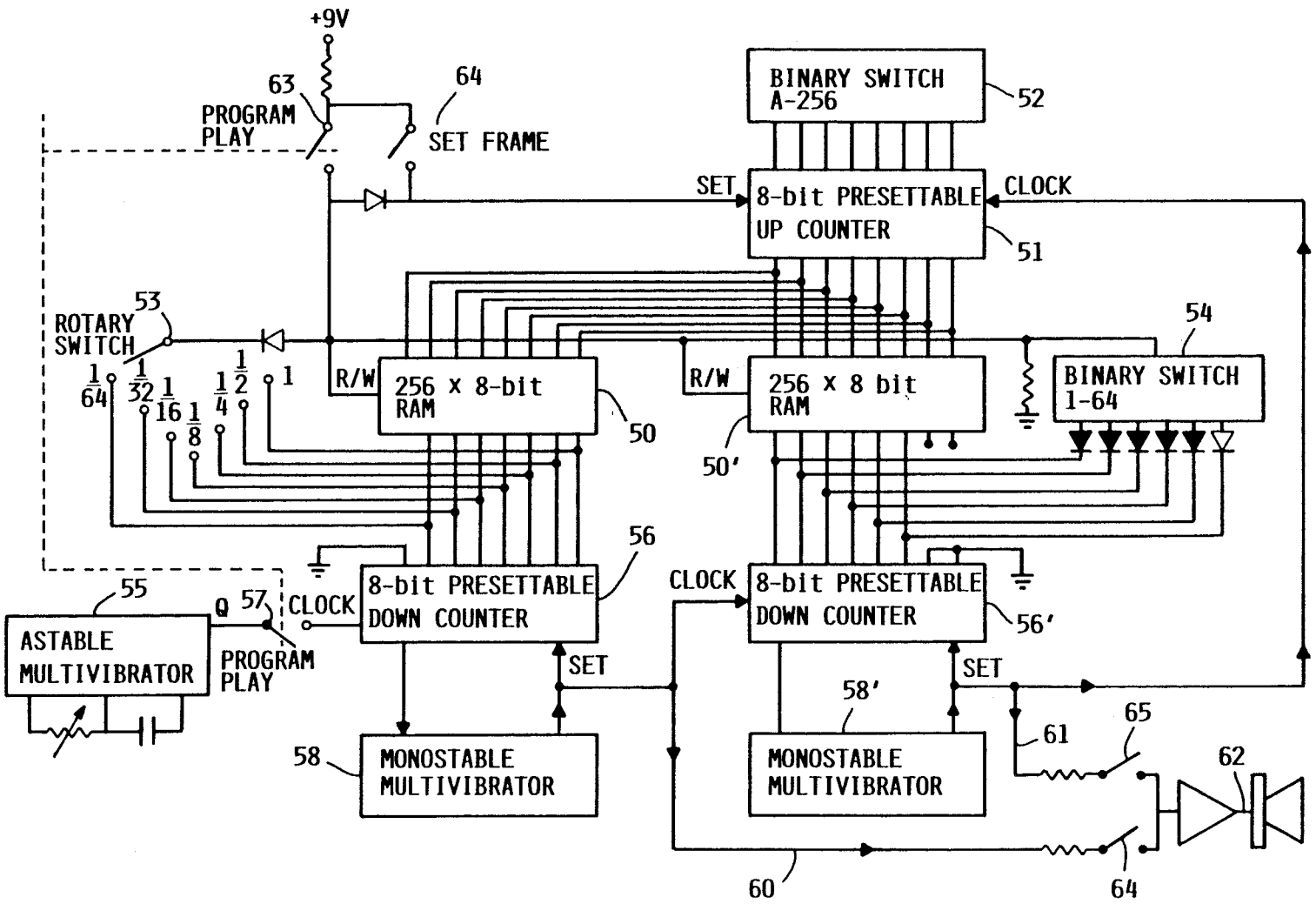
Figure 6:
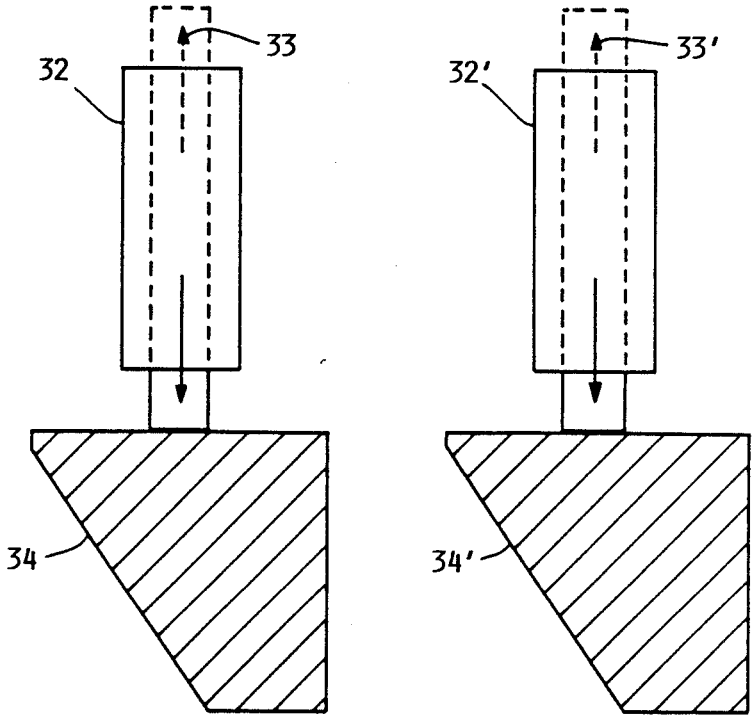

FIGS. 3*a* and 3*b* are flow charts illustrating the operations required for saving the digital data sequences, stored in the volatile memory of the device, by recording them in a hard memory, and for loading into said volatile memory data sequences previously recorded in a hard memory, respectively;

FIG. 4 reproduces a few bars of a piano sonata for the purpose of illustrating the use of the device;

FIG. 5 is a block diagram illustrating a second embodiment of the device according to the invention; and FIG. 6 is a schematical illustration of one means of producing a signal directly perceivable by the human senses.

Figure 1:
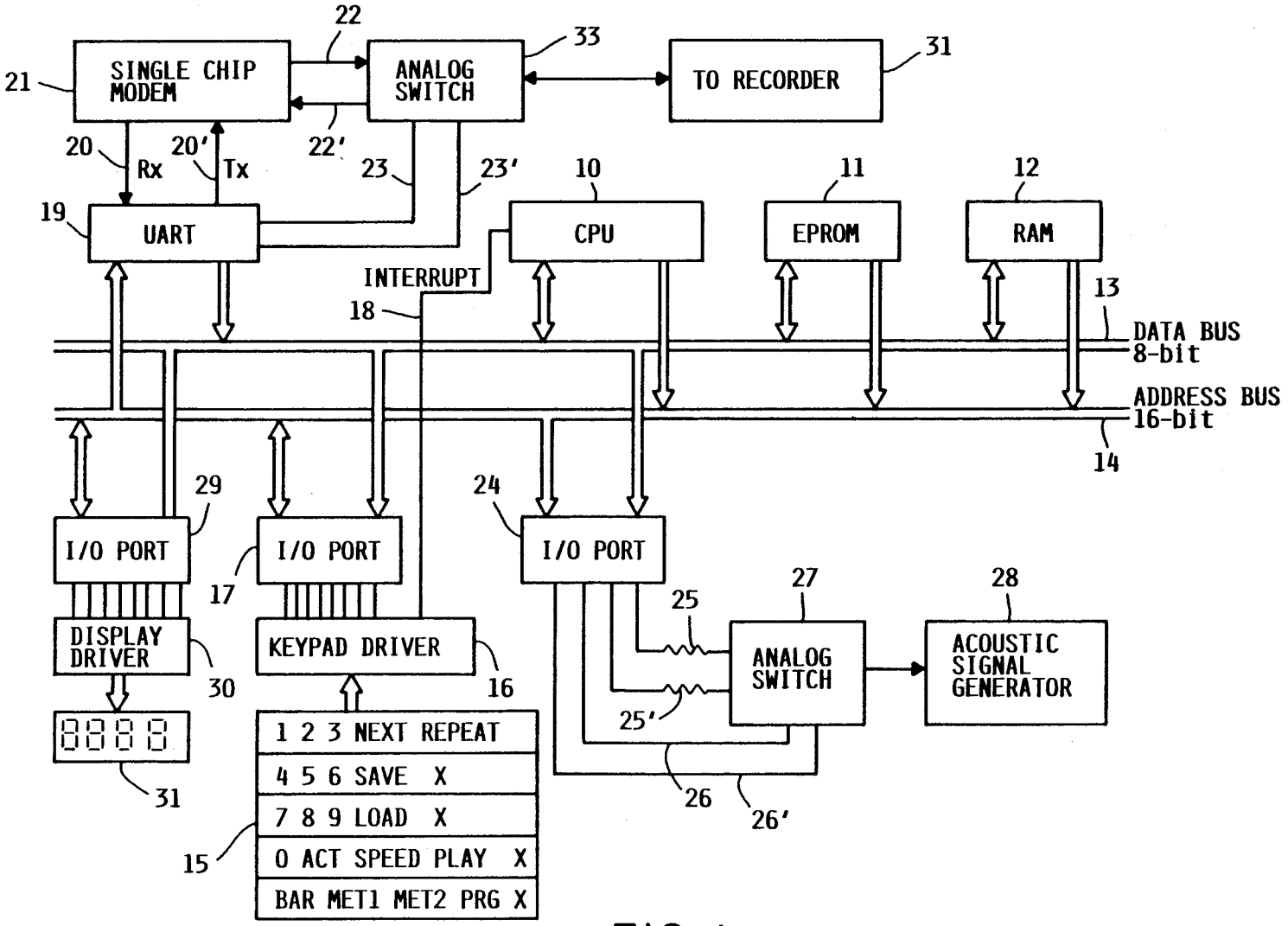
FIG. 1 is a block diagram of a first embodiment of the device.

Referring now to FIG. 1, in a first embodiment of the invention numeral 10 indicates a CPU (Central Process Unit) of any known suitable type, such as used in microcomputers. CPU's are available on the market and, while they may be of different types, they are all suitable as components for the metronome device herein described. Numeral 11 designates a PROM (Programmable Read Only Memory) or an EPROM (Erasable Programmable Read Only Memory), both of which are examples of non-volatile memories, and numeral 12 a volatile memory, viz. a RAM (Random Access Memory), all such components being well known and easily accessible to persons skilled in the art. The device further comprises a Data Bus 13 and an Address Bus 14, to which the aforesaid components are connected as shown.

The device according to this embodiment comprises manually controlled operating means, which comprise manually operated means for imparting operating instructions and defining data, as required. Any such means can be used. Generally key means are preferred and are incorporated in a keypad or keyboard 15, having any number of keys that may be required. In the embodiment illustrated, there are twenty keys: ten number keys, from 0 to 9, and ten command keys, four keys corresponding one each to the two bar and speed variables, and two to the meter variable, an additional key designated as "Accent", the function of which will appear hereinafter, and "Save", "Load", "Program", "Play", "Next" and "Repeat" keys. More keys could be provided, if required: four blank keys are shown in FIG. 1 and are available for such purpose. Alternatively, the "Repeat" key could be ommitted, if the "Next" key has a locked position which will perform the same function. Two "Meter" keys are not strictly necessary, as one would suffice, provided that care is taken to use a single key in such a way as to avoid ambiguities, e.g. by giving the two meter data always in the same order. Thus one key could be freed for another command or datum. However, in this case, both meter numbers must be entered, even when only one of them is changed from one bar to the next. The said keys actuate a key driver 16, also a standard device, or another suitable device for transforming the signals, given by the operator by depressing the keys or operating other control means, into suitable digital signals, and which is connected, through an input/output port 17 to the Data and Address Buses. The decoder 16 is connected as at 18 to one of the "interrupt" legs of the CPU. The components described constitute, in this embodiment, the means for storing a sequence of digital data in the volatile memory (RAM) 12, in the manner and for the purposes hereinafter described, while the program which interprets and executes the keyboard commands has previously been stored in the non-volatile (e.g. PROM or EPROM) memory, in the manner that will be later described.

A lithium battery (not shown) will preferably be provided to maintain the RAM, if a suitable, e.g. CMOS, type, under constant tension, to avoid loss of stored data in case of failure of the tension applied to the device. Nevertheless it may be that the RAM is of a different type, or that the sequence of data to be stored will exceed the capacity of the RAM, or that some data should be kept for an indefinite length of time. For these purposes means are preferably provided for recording the information contained in the digital data sequence in a hard memory, such as a magnetic tape or a floppy disk, or other suitable means. For instance, the Buses 13 and 14 are connected to a suitable interface, which in this embodiment comprises a UART (Universal Asynchronous Receiver-Transmitter) 19 and this latter has an output/input connection, symbolically indicated by wires 20—20′ (Rx-Tx) to a single chip MODEM (Modulator-Demodulator) 29, which in turn is connected, as indicated at 22—22′, to an analog switch or like device 33, which determines whether data are coming into or going out of the metronome device, and which is also connected, as indicated at 23—23′, to the UART. The MODEM transforms the digital voltages it receives through the UART (which, as is known, transforms the group of parallel signals it receives into individual signals arranged in series, and viceversa) into oscillatory signals of audio frequencies. The analog switch is connectable to any suitable recording device 31, such as a magnetic tape recorder, not shown and of any conventional type. Said switch and the MODEM constitute the interface of digital data storing components to a hard memory.

The Data and Address Buses 13–14 are also connected to an interface to means for generating signals directly perceivable by the human senses. This preferably comprises a port 24, adapted to send out two voltages, which may produce signals of different intensities, e.g. through the actions of two different resistances 25—25′. The port also actuates, through connections 26—26′, an analog switch or like device 27, to allow at any given time the stronger or the weaker signal (or both or none, as the case may be) to pass through to a device 28, suitable for generating a directly perceivable signal, as hereinafter explained.

A visual signal display is also preferably provided. For example, the Buses 13–14 are connected, through a suitable output/input port 29, to a display driver 30 and through this latter to a visual display 31, of any suitable, known type. The display will show the commands or data entered by the keyboard into the volatile memory or that are being stored in a hard memory, or the indications about the operations which are being executed, or the directly perceivable signals which are being sent out.

The operation of the above components is as follows:

The non-volatile memory (PROM or EPROM) contains a list of all the commands which may be given by means of the particular keyboard that is present in any particular embodiment of the device according to the invention. Each time that an operative command is given by means of a key, the "interrupt" is actuated, and the CPU is activated to interpret said command. The list of commands which has been recorded in the non-volatile memory furnishes the interpretation of the command and determines what operation is to be carried out. If the command is not an erroneous one, in which case the device will react to indicate the error in any suitable way (such as by a visual or acoustic alarm), the type of command will determine the subsequent operation of the device. It may be that the command suffices in itself to set in motion a series of operations, which are then carried out. Or it may be that the command requires waiting for a further information, which may another operative command, or a numerical data, in which case the command determines how the numerical data, to be received, should be interpreted. The program stored in the non-volatile memory determines in what segment and position of the volatile memory the numerical data should be stored, or, if the device is not storing but reading data, it determines where the data to be read are to be found in the non-volatile memory.

For the purposes of this invention, the signals directly perceivable by the human senses may preferably be of one of three types (or more than one type of signal may concurrently be generated). The first type is an acoustic signal. For the purposes of this invention such signal must be as sharp as possible and substantially pitchless. The word "pitchless" should not be construed as meaning that the acoustic signal cannot be made up of a number of substantially sinusoidal components, each having a given frequency and therefore a "pitch". It does mean, however, that the overall signal, no matter what its components or the characteristics which the physical analysis thereof may reveal, is not perceived by the musically trained human hear as a definite note, but rather as a "noise" with which the ear does not associate a specific pitch. The signal should be "sharp", which means it should be of short duration and reach its maximum intensity and drop from such an intensity to zero or nearly zero as quickly as possible, so that as to be ideally perceived by the human ear as nearly instantaneous.

Mechanical and electronic means for generating such acoustic signals are known and employed, e.g., in mechanical and electronic metronomes respectively, and need not be described. More sophisticated electronic means for generating an acoustic signal, that is better for the purposes of this invention, can be devised by the skilled person. Thus a model acoustic signal may be produced, e.g., by mechanical means and may be analyzed to determine its spectral components defined in terms of frequencies and relative intensities. The signal may then be electronically reproduced by generating the said frequencies in the appropriate intensity relationships.

A signal generating device of this type, however, would be expensive and in general too bulky for this device, which is desirably as small as possible. Therefore electromechanical means, such as illustrated in FIG. 6, may be employed. These comprise one or preferably two electromagnets 32—32', which will be energized as hereinafter explained. When one of said electromagnets is energized, its piston 33—33' will strike a solid body, such as a lamina 34—34', to generate a sharp, pitchless sound. The use of two electromagnets will provide a louder or softer sound, as desired, for the purposes hereinafter described. Upon inactivation of the electromagnet, its piston will be returned to its initial position by a return spring 36–37, or alternatively, two additional laminae 34'–35' may be provided, as indicated in broken lines in FIG. 6, and the direction of flow of the current in the electromagnet windings may correspondingly be reversed, by means that are easily within the purview of the skilled person.

Another type of signal may involve exerting a pressure upon a part of the human body, without producing a significant sound. Such a signal is particularly useful, e.g., when the metronome is used for recording the playing of music or whenever it is desirable, for any other reason, not to produce an audible sound. It is to be noted that a metronome according to the invention may be imparted a very small volume and may even be constructed in the shape and size of a wristwatch. In such a case it may be worn on a person's wrist and the directly perceivable signal may consists in a pressure exerted upon the wrist. Alternatively, the metronome may be inserted in a shirt pocket or like part of a garment or strapped close to the skin or to a light garment. Electromechanical means, such as illustrated in FIG. 6, may be used for such a purpose, or other suitable means may easily be devised by the skilled person.

The third type of signal, that can preferably be used according to the invention, is an optical signal. This is conveniently provided by the aforementioned display, which may "blink", exhibiting a signal the intensity of which may be varied. Many kinds of display capable of such an operation are known, such as LED (Light Emitting Diodes) and the like.

Two types of signals may concurrently be generated. It is desirable in most cases that an optical signal be associated with an acoustic or a mechanical signal.

The interface to means for generating the directly perceivable signals may be connected to and actuate several such means. E.g. the analog switch 27 may be connected to a number of signal generating devices, similar to device 28 or at any rate suitable for generating acoustic, mechanical or visual signals. Alternatively, device 28 may be replaced by means for generating a wireless, e.g. a radio, signal. which may be received by and concurrently actuate a number of signal producing means. In this way the same signals may be generated at various points and perceived by different persons concurrently. This may be useful, e.g., in orchestra rehearsing. The radio or other signals may be programmed to have different wave lengths, and the various signal producing devices may be differently tuned to receive different wave lengths, so that the same metronome device may generate different sequences of signals for different users, e.g. players of different instruments.

The volatile memory (RAM) will preferably comprise the following segments: bar number, first meter number (M1/), second meter number (M2), speed, and accent. Additionally, two individual memory locations are provided, one of them continuously updated with the last bar number entered, and the second containing the first bar number of the sequence considered.

The bar numbers indicate the sequency of the bars in the score that is being analyzed, and increase sequentially by one unit at a time.

The first meter number indicates the number of submultiple units included in the bar: e.g., if the meter is $\frac{3}{4}$, the first meter number will be 3/. The second meter number indicates the number of submultiples into which the bar is ideally divided and in relation to which the speed is defined: e.g., in the aforesaid case, it would be 4. For reasons that will appear hereinafter, said second meter number is preferably, though not necessarily, considered as a multiple of a basic bar submultiple, that is fixed once and for all for each metronome, and is preferably a power of 2, usually 32, 64 or 128. Means could be provided for varying said basic submultiple from time to time in the same metronome. Choosing a basic submultiple of 128 is possibly needlessly sophisticated for most cases, while choosing 32 may be insufficiently sophisticated for some, particularly complex cases. Therefore, by way of example, it will be assumed that a basic submultiple of 1/64 of a bar is adopted.

The speed is the frequency (per minute) of the bar submultiple defined by the second meter number. Thus, if said number is 4 and the speed is 60, this means that the metronome is required to beat one fourth of a bar sixty times per minute. Sometimes the speed may be indicated by a musical term, such as Largo or Allegro, and not by a number, but the musician will know, or will easily determine by using well known charts, what range of numerically expressed speeds corresponds to each such term. However it should be considered that in some scores the speed may be referred to different bar submultiples in different parts of the score. With this in mind, the device according to the invention may operate as follows.

The actual frequency of the basic bar submultiple will be determined by an internal clock, which exists in the CPU, preferably a crystal clock. Actually the real frequency of the crystal clock is much higher than that of any practical submultiple, but the CPU will count a given number of cycles of its internal clock as a "burst" of cycles defining the basic submultiple. The non-volatile memory will contain a table indicating the number of basic submultiples, to be counted before beating out a pulse, for any given second meter number. Thus, if the basic submultiple is i/64 of a bar, and the second meter number is 16, 4 basic submultiples will be counted before beating out a pulse; if the second meter number is 4, 16 basic submultiples will be counted, and so on.

When the simplest operation is desired, the operator will read for each bar the two numbers defining the meter and will enter them for each bar. The speed will always be referred to the particular bar submultiple that is defined by the second bar number and the operator will enter the corresponding speed for each bar. E.g., if the first bar is in $\frac{3}{4}$ and the speed, referred to $\frac{1}{4}$ of a bar, is 120, he will enter the numbers 3/, 4 and 120. Subsequently, if the speed, referred to the submultiple of the bar, is not changed, he will only enter the meter numbers. E.g., if the meter becomes $\frac{3}{8}$ and the speed referred to $\frac{1}{4}$ of a bar remains 120, he will enter 240 as the speed number. The device will be so programmed, as explained hereinafter, that if no speed number is entered for a given bar, the device will store for that bar the last previously entered speed. In this mode of operation, the device will interpret the speed number as the frequency of the submultiple indicated on the score for any specific bar.

In a preferred embodiment of the device, the speed number will be interpreted by the device as defining the frequency, not of the bar submultiple, but of the basic, fixed submultiple hereinbefore mentioned. In order to define the frequency of the submultiple of each bar, which determines the frequency of the actual perceivable signal, the device will determine how many basic submultiples are contained in every specific bar submultiple. For this purpose, the device will read the second bar number, divide the fraction of bar corresponding to the basic submultiple by the second meter number, and count out a number of basic submultiples equal to the ratio thus obtained, to make up the bar submultiple. Thus, if said ratio is, e.g., 16, the device will count 16 basic submultiples between each pulse and the successive one.

Figure 2A:
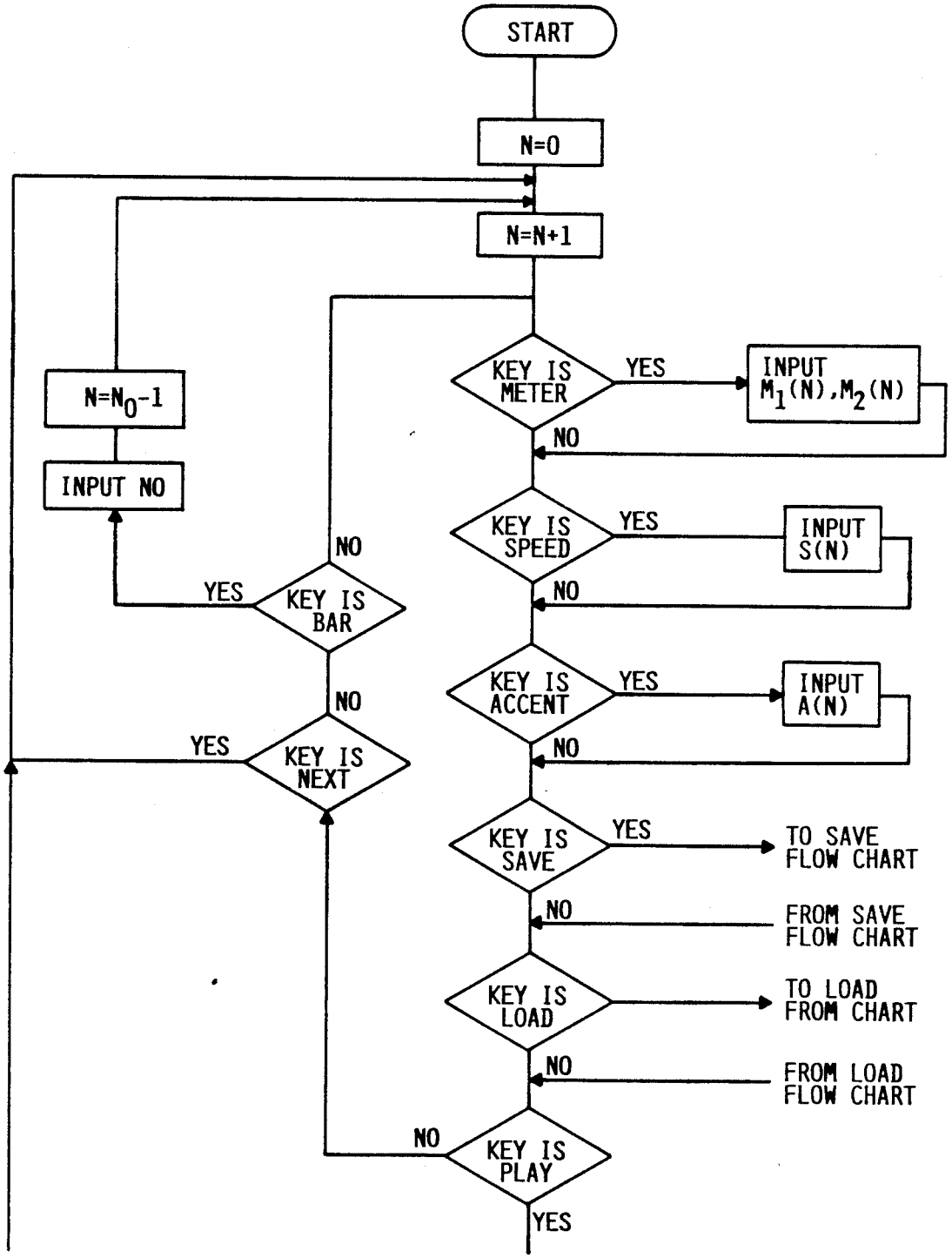
FIG. 2 is a flow chart illustrating the operation of the device in storing or playing data sequences into and from the volatile memory, which figure, for reasons of size, has been divided into two parts, 2*a* and 2*b*, the first of which being relative to the storing sequence and second to the playing sequence.
Figure 2B:
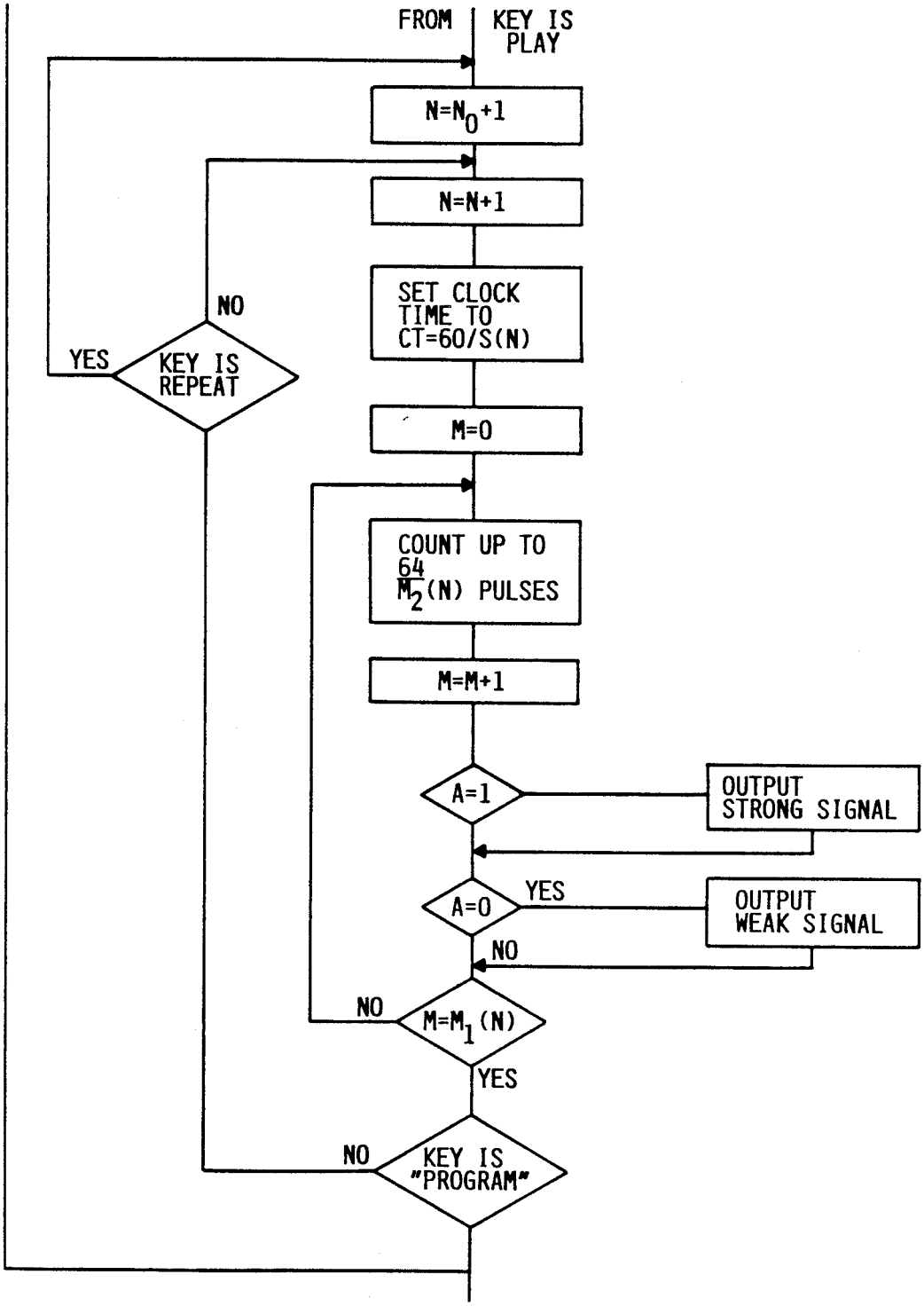

Now then, with reference to FIG. 2, when the device is switched on, and unless a different command is given, the bar number (N) will be automatically set at a "default" value of zero and will then automatically increase to 1. If the reading or playing of a score is to begin at a point that is not the initial one, the "Bar" key will be actuated and the corresponding initial bar number No be entered. Since no other command key has been actuated, the device will go, as the chart shows, to a bar number $N=No-1$ (in place of the default value $N=0$) and then to $N=N+1$, viz. No. Operations will then begin from said initial bar number.

At this point, actuating the "Meter" key, will indicated that the two meter numbers M1/ and M2 must be received (the order in which they are received being immaterial, if there are two meter number keys, but being mandatory if there is only one meter key). If they are received, they will be stored and the scanning of the chart will advance to the "Speed" stage, and will so advance also if the "Meter" key is not actuated. Likewise, if the "Speed" key is actuated, a speed number will be expected, and if received, it will be stored and the scanning will advance to "Accent", and will so advance also if the "Speed" key is not actuated. The same is true of the "Accent" key, actuating which, however, will prepare the memory to receive a number which can only be 0 or 1. If the "Accent" number is 0, the device will mark, acoustically or otherwise, only the first beat of a bar. If the "Accent" number is 1, it will mark the other beats as well, but with a lesser intensity. It may exceptionally be that it is desired to accentuate not only the first beat of each bar, but more than one, say the first and third. The required modification in the device (the provision of an additional key) and in the flow chart will be within the purview of the skilled person. However the same result is more easily attained by the operator, who will consider a bar in which the first and third beats, e.g., are to be accented (or are the only ones to be marked) as composed of two bars, beginning the first at the first beat and the second at the third beat. Thus, in such a case, a 6/8 bar will be consiered and entered as consisting of two successive $\frac{3}{8}$ bar.

At this point, if the "Save", "Load" and "Play" keys are not actuated, as they normally will not be when a score is being read, the device, after a fixed small time interval, will go back to the point immediately following the bar number setting and the resulting loop will be scanned repeatedly until the "Next" key is actuated. Said key will advance the program to the next bar (unless a different, initial bar number is chosen at this point) and all the above operations will be repeated, until all the score, or such part of it as has to be read, has been read. If one or more of the other comand keys fail to be actuated before the "Next" key is actuated, the last values of the variables related to such commands are stored in the volatile memory as pertaining to the bar which has been left behind because of the "Next" command. If a number of bars having the same rythmical data are to be entered succesively, the operator will keep the "Next" key depressed (or in the locked position, if it exists) and check the bar numbers on the visual display. Alternatively the "Repeat" key could be used, but this mode of operation, being less preferred, is not shown on the chart.

It is often desired to begin the operation of the metronome with an "empty" bar, viz. a fictitious bar having the same character as the first actual bar of the score. This is achieved by the operator by entering the first actual bar twice in succession, and remembering that the first bar is an "empty" one. In practice he will enter the first bar and then immediately actuate the "Next" key, without giving any further command.

After completing the reading, the operator may transfer the digital data sequence to a hard memory, and will do so by actuating the "Save" key, which will interrupt the scanning of the above described loop and cause the operations set forth in the "Save" flow chart, hereinafter described, to take place. The program will then return to the loop, at which point operations may be interrupted by switching off the device.

Two more keys are inserted in the aforesaid loop. The "Load" key, when actuated, will cause the data sequence stored in a hard memory to be load into the volatile memory, through the same series of operations described above, and once again, beginning from the first bar or from whatever No bar has been selected as the initial point. The "Load" flow chart will be described hereinafter. On the contrary, if the "Play" key is actuated, when one wishes to transform the digital data sequence of the volatile memory into directly perceivable signals, in order to study or play a score, the device stops scanning the loop described above and proceeds to the following operations.

The volatile memory has retained the initial number No (as hereinbefore set forth) and will automatically go to N=No−1, or, if No has not been entered, will go to default value 0. In both cases, it will then automatically go to N=N+1. The inner clock operates at the frequency of the basic submultiple. The initial number M of pulses, to be sent out as directly perceivable signals, is of course zero. From then on the device counts, for each pulse, as many basic submultiples as required by the second bar number. If the basic submultiple is, e.g., 1/64 of a bar, it counts 64/M2 basic submultiples and sends out one pulse to the output connected with the directly perceivable signals generating unit, which beats one pulse. This is always a strong pulse, being the first one of a bar. The fact that a pulse has been added is then recorded: M becomes M+1. If the "Accent" key has been actuated to 1, the following pulses of the bar will be sent out as weak ones. If it is desired to omit the weak pulses, the "Accent" key will be actuated to zero. Alternatively, two "Accent" keys could be provided for more sophisticated operation. The aforesaid operations will be repeated loopwise, as indicated, until M has attained the first meter number M1 of that particular beat, at which point, if the device is used for storing a data sequence, and therefore the "Program" command has been given and has not been superseded by another incompatible command, the data storing operations will be initiated once more, while if not, the device will continue scanning the playing loop, from the next bar N=N+1. However, it may be that the piece being studied has the same speed and meter in numbers throughout. In this case the "repeat" key will be actuated and the flow chart will return, as shown, to the first bar and repeat the same signals indefinitely. In this case, the motronome according to the invention will operate like a conventional metronome.

The flow chart hereinbefore described can easily be translated by skilled persons into a program, in Basic or other suitable language, suitable for loading into a general purpose computer, for the purpose of storing the corresponding program into a non-volatile memory, to be used as component for the device according to the invention. The programming of non-volatile memories in this way is well known in the art. All other components are avaible as such on the market or can easily be made from available parts.

The "Save" flow chart of FIG. 3*a* will now be described. In this chart, for the sake of greater clarity, the variable bar number is indicated by K and not by N: the "N" notation indicates the bar number brought over from the main flow chart. As is seen, when the "Save" key has been actuated, the bar number K goes to a default value K=No−1 (No having been initially entered, as explained hereinbefore, or if not, the default value being 0). A "preamble", viz. a predetermined series of digital numbers such as can never occur as data signal, exists in the non-volatile memory and is sent by the CPU to the UART, thus consenting access to the "Save" loop. In said loop, the bar number automatically increases at every scanning by one unit (K=K+1). Then the Speed, the Accent and the two Meter numbers are read from the volatile memory and are sent out, in a conventional manner which need not be described, through an appropriate interface, as hereinbefore set forth, to whatever hard memory is being used, through any known, suitable recording device. The volatile memory has stored, in the special segment provided, as hereinbefore set forth, the maximum bar number Nmax attained in the data sequence stored in said memory. When K has reached said value Nmax, the "Save" operation has been completed and the corresponding loop is abandoned, an end sequence, similar to the aforementioned preamble and indicating the end of the "Save" operation, consenting the return of the device to main flow chart of FIG. 2.

The "Load" flow chart of FIG. 3*b* will now be described. The operations of this chart start, once again, from a default value K=No−1 (or 0, if no No has been stored). The recording device or the like, which sends out the signals recorded in the hard memory, and which is connected to the device according to the invention, e.g. as schematized in FIG. 2, in any suitable, conventional manner through the aforementioned interface, is activated. When it has sent out a preamble, as hereinbefore described, the signals which follow are loaded into the volatile memory and the scanning of the "Load" loop begins. The bar number K is updated by being increased each time by one unit (K=K+1). The Speed, the Accent and the two Meter numbers, which follow one another in a predetermined succession, are stored in the appropriate locations of the volatile memory. At each scanning of the loop, the bar number K is stored in the segment of the volatile memory destined to the maximum bar number Nmax and is thus continuously updated. When K reaches said Nmax value, which has also been recorded in the hard memory, as noted in describing the chart of FIG. 3, the end sequence indicates that the loop should be abandoned and the device returns to the main flow chart of FIG. 2.

FIG. 4 serves to illustrate the commands to be given by means of keys or the like, to store, in the metronome device according to the described embodiment of the invention, the data relative to a few bars of Bartok's piano Sonate. The said bars are reproduced in the figure. It is assumed that the operator wishes to have an "empty" bar at the beginning and that he wishes to hear all the beats of each bar, the first being stronger. The key commands are as follows:

START
M1/=3
M2=8
S=340
A=1
NEXT
NEXT
M1/=2
M2=4
S=170
NEXT
NEXT

M1/=1
NEXT
M1/=3
M2=8
S=340
NEXT
M1/=2
m2=4
S=170
NEXT
M1/=3
M2=8
S=340
NEXT
M1/=2
M2=4
S=170
NEXT
M1/=3
M2=8
S=340
NEXT
M1/=2
M2=4
NEXT
NEXT
M1/=1
NEXT

Of course, any number of "empty" bars could be provided, at the beginning or at any point of the piece or of any other piece, by depressing the NEXT key as many times as necessary.

Another possible embodiment of the device will now be described with reference to the block diagram of FIG. 5. Said embodiment comprises a volatile memory, indicated in the drawing as comprising two separate RAM's 50—50', but which could consist of one or any number of RAM's, constituting a number of segments. A Presettable Up Counter 51 registers the bar number N. It is preset, by means of a Binary Switch 52, at any desired number N and each time it receives an impulse, it counts forwards by one unit. The resulting bar number N constitutes at all times the address of the volatile memory. The RAM's send out—or store, depending on whether the operator is reading or registering a score—the binary numbers corresponding to the addresses they receive. In the particular embodiment illustrated, the RAM 50 sends out or stores a number corresponding to the second meter number M2. As has been said, the number of bar submultiples per bar is usually a power of 2: such powers, up the sixth power (64) have been indicated as the denominators of fractions of bar in the diagram. A Rotary Switch 53 is actuated to select the appropriate second meter number M2. RAM 50' send out or stores the first meter number M1/, which is selected by means of the Binary Switch 54. The bar number N and the two meter numbers M1/ and M2 can thus be stored in the volatile memory or retrieved therefrom, by selecting, through counter 51, the appropriate memory addresses.

The operations required for reading stored digital data sequences will be considered firstly. The Astable Multivibrator 55 produces a clocked impulse, having the fixed frequncy of the basic bar submultiple, and transmits such impulse to a Presettable Down Counter 56. Said Counter is preset by the values which are sent to it by the RAM 50, while similar Counter 56' is similarly preset by the values sent by RAM 50'. At the beginning of the reading, the Switch 63 is set at "Play". The counter 56 then counts out as many basic submultiples as is required by its presetting: thus, if RAM 50 has stored, at the address that is operative at the moment, a second meter number 8, and the basic submultiple is 1/64 of a bar, counter 56 will count out 8 basic submultiples and will then send out a pulse to a Monostable Multivibrator 58. Said vibrator, after a short delay, sends put a corresponding pulse to counter 56'. This latter has been preset by RAM 50' with the value of M1 and therefore counts out M1 pulses (bar submultiples) and then sends out a signal to counter 51, as indicated at 59, to increase the bar number N by a unit and cause the aforesaid operations to start again with respect to the next bar. The pulses from the vibrator 58 are also transmitted, as indicated at 60, through a switch 64 to a device 62 for producing a directly perceivable signal, to produce weak signals, normally indicating beats that are not the first one of a bar. If it is desired that only the first beat of each bar be marked, switch 64 will remain open to interrupt the transmission of the pulses from vibrator 58. The pulses of vibrator 58' are similarly transmitted, as indicated at 61, through switch 65 to produce a signal indicating the first beat of a bar. In the drawing, an acoustic signal producing device 62 has been schematized, but this involves no limitation, as any other type of signal can be used and the corresponding signal producing device be provided.

The switch 63 commutes the device between the "Play" position, in which it operates as described, and the "Program" position, in which it stores the digital data sequences in the volatile memory. The RAM's pass from the "read" to the "write" access position, both positions being normally provided in RAM's and like devices, as is well known to persons skilled in the art. The "Set Frame" device determines the bar number at which the operations are to begin. Once again, binary switch 52 is operated to update the bar number and the RAM's load, for each such number, the meter numbers entered by the operator by means of the switches 53 and 54. The switches 64–65 perform the function performed by the "Accent" key in the previously described embodiment.

It is to be understood that the various components and devices described may be incorporated in one or any other desired number of physically distinct structures. Thus, e.g., the recording device and/or the signal producing device or devices may be parts of the same physical structure which incorporates the memories and the CPU of FIG. 1 or the electronic components of FIG. 4, or they may be separate from it, partly or wholly. Any number of constructional combinations is possible.

The manually controlled signals producing means need not be key-controlled, and a certain economy and facility of operation may actually be achieved by using means in which the manual control is only limited.

Thus, e.g., the digital signals associated with bar number, speed and meter, as well as the intensity of the signals perceivable by the human senses and any other desired data, can be stored in a perforated or magnetic card and the metronome device can be provided with a conventional card reader that will read all signals and transmit the corresponding digital data to an electronic, normally a volatile memory. The operator of a keyboard-controlled metronome device, as hereinbefore exemplified, may transfer the digital data sequence, read and registered by him, to a hard memory. The hard memory may be a magnetic card. Such a card may thus be prepared and then passed through the slot of the card reader to load the digital data sequence into the metronome device. Obviously, it could be used to load them into a different metronome device, not provided with a keyboard but with a card reader.

As hereinbefore noted, the metronome device may be connected to a recorder of any type, which may record the data sequence, e.g., on a tape. It is clear that, if one eliminates the keyboard and related elements from a metronome device, one may still use it, provided tapes or other forms of hard memory, such as magnetic cards, are available, in which the desired data sequences are stored. Therefore, if such tapes or cards or the like were available, no keyboard-controlled means would be required and one would only have to read the hard memory and store the read data sequences in the (usually volatile) memory of the metronome. Keyboard-controlled or equivalent means would be required only to prepare the tapes or cards or the like, and this could be done by a supplier and not by the user.

Another form of hard memory reading means would involve the use of bar cards. Since the meaning of the word "bar" in this connection is different from that of said word as used in the parent application, we will refer to the latter meaning, when both are present in the same context, as "musical score bar". A number of bar cards could be prepared, each of which stores a combination of musical score bar number, speed, meter, and—if required—signal intensity or other information. Each bar card could be attached to the appropriate musical score bar on the score itself, and the several bars could be read, in the appropriate succession, by passing a magnetic stick over them, as commonly done in stores to read bar card labels, the magnetic stick being connected to the metronome device in an obvious manner to convey the signals read to the appropriate (usually volatile) memory segment. Musical scores could also be printed in such a way as to incorporate the appropriate bar card adjacent to the corresponding musical score bar, and these could be read as said above.

The signals associated with bar number, speed, meter and possibly other variables, need not originate as magnetic signals, but might be optical signals, transformed by transducer means into electric or magnetic signals. Thus, perforated cards or tapes could be used as hard memory, and light signals could be received by light-sensitive components, e.g., photoelectric cells, from a light source through the perforations, and translated into electrical or magnetic signals, e.g., by the cells themselves. This would involve no difficulty for a person skilled in the art.

Mechanical signals could also be used, e.g., pneumatic signals obtained by means of a perforated tape or card, a source of pressure or depression, and a pressure sensitive transducer.

In all cases, the manual operations required for producing the signals associated with the variables would be limited to passing a card through a card reader or operating means for passing a tape through a tape reading device or passing a magnetic stick across a bar card or the like. All other operational stages would be mechanical or electromagnetic.

All the aforesaid modified embodiments of the invention would permit to embody the digital data sequences into a hard memory at a central location, e.g., at the metronome manufacturer's or at the musical score publisher's or elsewhere, and the user could use the hard memories without having to read the score directly. While this would limit the versatility and educational value of the metronome, it would render its use somewhat easier and its manufacture cheaper, in comparison with the other preferred embodiments described.

The embodiments of the device according to the invention that have been described are intended as illustration thereof, but it is to be understood that many variations, modifications and adaptations, in addition to those explicitly considered, can be made therein by persons skilled in the art, without departing from the concept of the invention or exceeding the scope of the appended claims.

I claim:

1. A metronome device programmable to produce perceivable output signals of at least the varying speed and varying meter at the numbered bars of a complex musical score, comprising:

means for connecting the device to a source of electric power to energize the several components thereof;

at least partially manually controlled means for producing, when energized, digital signal values associated with at least three variables comprising bar number, speed and meter;

at least one volatile electronic memory, comprising a plurality of memory segments, for storing said values;

means for correlating at least one of said memory segments to the digital value of each of said variables and for conveying each digital value to the appropriate segment, to define a digital data sequence;

means for producing substantially sharply defined signals directly perceivable by the human senses;

means for reading the digital data sequences stored in said volatile memory segments, whereby to associate to the digital value of each bar number corresponding digital values of the speed and of the meter;

transducer means for transforming, when activated, said digital values into electrical impulses for activating said directly perceivable signal producing means to produce a succession of said perceivable signals corresponding to the speed and meter values associated with the successive bar numbers; and means for activating said transducer means.

2. A metronome device according to claim 1, comprising second transducer means, provided with an inlet/outlet, for transforming the digital data sequence stored in the memory segments into a sequence of recording signals suitable for recording onto a hard memory and for transforming said recording signals into the digital data sequence to be stored in said volatile memory segments; and means for selectively activating said transducer means to perform either of the aforesaid functions.

3. A metronome device according to claim 1, wherein the directly perceivable signals comprise pitchless acoustic signals.

4. A metronome device according to claim 1, wherein the directly perceivable signals comprise mechanical stimuli perceivable by a part of the human body.

5. A metronome device according to claim 1, wherein the directly perceivable signals comprise optical signals.

6. A metronome device according to claim 1, wherein the manually controlled means associated with the speed comprise means for producing a signal value representing the frequency of a given submultiple of a bar.

7. A metronome device according to claim 6, wherein the means for producing a signal value representing the frequency of the submultiple of a bar comprise means for defining a number of fixed, submultiple bar units, having a basic frequency, included in each submultiple.

8. A metronome according to claim 7, wherein the manually controlled means associated with the meter comprise means for producing a first digital signal value defining the number of submultiple units included in each bar submultiple and a second signal value defining the number of submultiples included in each bar.

9. A metronome device according to claim 1, wherein the means for correlating at least one volatile memory segment to the digital signal values of each variable and for conveying each signal value to the appropriate segment comprise a CPU and at least one programmable non-volatile memory.

10. A metronome device according to claim 1, wherein the means for correlating at least one volatile memory segment to the digital signal values of each variable and for conveying each signal value to the appropriate segment comprise a plurality of non-volatile memories.

11. A metronome device according to claim 1, wherein the plurality of volatile memory segments are physically embodied in a number of volatile memories comprised between one and a number smaller than the number of segments.

12. A metronome device according to claim 1, comprising means for retrieving each datum of the stored digital data sequence and conveying it to the transducer means.

13. A metronome device according to any one of the preceding claims, further comprising means for selectively determining the intensity of the signals perceivable by the human senses.

14. A metronome device according to claim 13, wherein the means for selectively determining the intensity of the directly perceivable signals comprise means for selectively changing said intensity from a normal value to an intensified value and means for attributing said intensified value to at least one signal located at a given position in each bar.

15. A metronome device according to claim 1, further comprising means for causing the means for reading the data of the digital data sequence stored in the memory to begin the retrieving at any desired bar number.

16. A metronome device according to claim 1, wherein the manually controlled signal value producing means comprise means for reading the information stored in a hard memory.

17. A metronome device according to claim 16, wherein the hard memory reading means comprise card reader means.

18. A metronome device according to claim 16, wherein the hard memory reading means comprise tape reader means.

19. A metronome device according to any one of claims 16 to 18 comprising transducer mean for transforming nonelectromagnetic signals incorporated into a hard memory into electromagnetic signals.

20. A metronome device according to claim 1, further comprising a display means for displaying the digital signal values produced by the operating means and read from the memory.

* * * * *

UNITED STATES PATENT AND TRADEMARK OFFICE

CERTIFICATE OF CORRECTION

PATENT NO. : 4,974,483

DATED : December 4, 1990

INVENTOR(S) : Marco Luzzatto

It is certified that error appears in the above-identified patent and that said Letters Patent is hereby corrected as shown below:

In column 11, line 8, delete "$m^2$=4" and insert --M2=4--.

Signed and Sealed this

Fifteenth Day of March, 1994

*Attest:*

Bruce Lehman

BRUCE LEHMAN

*Attesting Officer*

*Commissioner of Patents and Trademarks*